US005765536A

United States Patent [19]

Scott

[11] Patent Number: 5,765,536

[45] Date of Patent: Jun. 16, 1998

[54] BOWSTRING RELEASE DEVICE

[76] Inventor: John William Scott, 587 Adams Ridge Rd., Clay City, Ky. 40312

[21] Appl. No.: 657,334

[22] Filed: Jun. 3, 1996

Related U.S. Application Data

[62] Division of Ser. No. 486,697, Jun. 7, 1995, which is a continuation of Ser. No. 191,385, Jan. 31, 1994, Pat. No. 5,448,983.

[51] Int. Cl.[6] ..... F41B 5/18

[52] U.S. Cl. ..... 124/35.2

[58] Field of Search ..... 124/35.2

[56] References Cited

U.S. PATENT DOCUMENTS

| | | | |
|---|---|---|---|
| 4,407,260 | 10/1983 | Lyons | 124/35.2 |
| 5,170,771 | 12/1992 | Peck | 124/35.2 |
| 5,170,772 | 12/1992 | Hamm | 124/35.2 |
| 5,357,939 | 10/1994 | Tentler et al. | 124/35.2 |
| 5,370,102 | 12/1994 | Peck | 124/35.2 |

*Primary Examiner*—John A. Ricci
*Attorney, Agent, or Firm*—Laurence R. Letson

[57] ABSTRACT

A bowstring release with a fixed jaw and a single movable jaw is controlled by a trigger mechanism to provide enhanced accuracy. The bowstring release mechanism is adapted to rotate about its longitudinal axis to readily align the jaws with a bowstring, and the bowstring release is further attached to a wrist strap by means of a ring or attachment plate having two relatively straight sides engaged by leather tabs on the wrist strap. The straight sides and the leather tabs control and define the location of the ring thereby removing positional variances of the point of force transmission between the wrist strap and the bowstring release device and eliminate at least some variations which will affect consistent bowstring draw and release. The use of both a single fixed jaw and a movable jaw improves the accuracy and the smoothness with which the bowstring is released by stabilizing the bowstring during the initial portions of its flight after release.

6 Claims, 3 Drawing Sheets

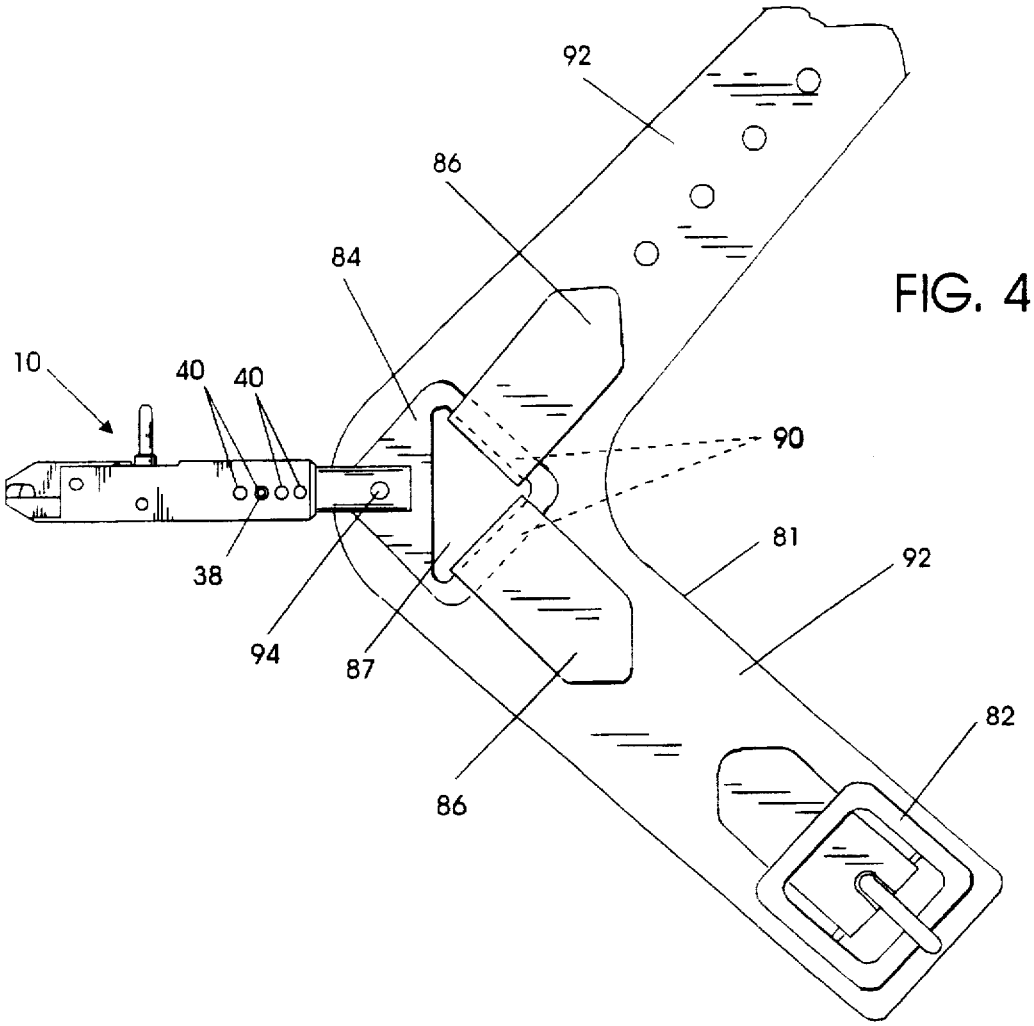
FIG. 4
FIG. 5
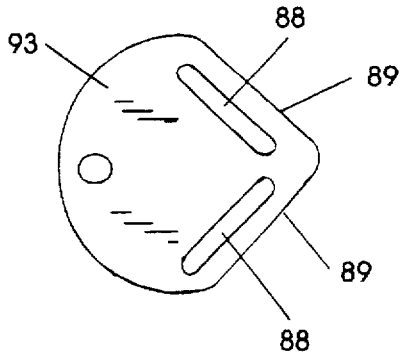
FIG. 6
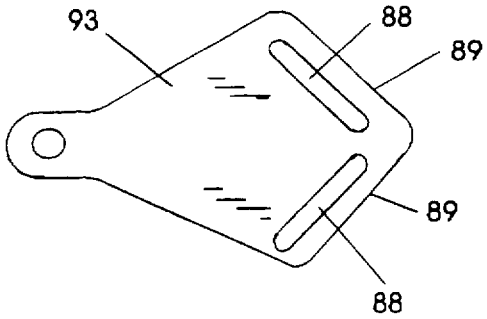

BOWSTRING RELEASE DEVICE

This application is a division of copending application No. 08/486,697 filed Jun. 7, 1995 which is a continuation of application No. 08/191,385 filed Jan. 31, 1994 now U.S. Pat. No. 5,448,983.

FIELD OF THE INVENTION

This invention relates to the release for a bowstring of a bow and more particularly to the device that releases the bowstring.

BACKGROUND OF THE INVENTION

Historically bowstrings have been drawn by use of the fingers on the hand of the archer. Manual release of the bowstring adversely affects the flight and accuracy of the arrow. Due to variables including lateral motion with the advent of compound hunting bows and their increased draw forces, a device must be used to draw the bowstring, in order to prevent injury to the fingers of the archer.

Bowstring release devices have been designed and developed which permit the release of the bowstring by the actuation of a trigger mechanism, thereby both minimizing the influence of the release motion and at the same time improving the accuracy of the trajectory of the arrow. To some extent these mechanical devices have eliminated the inconsistencies of the release and particularly the inconsistencies associated with a manual release.

With at least partial elimination of the variables in draw, hold and/or release of the bowstring, the accuracy of the archer may be substantially improved.

In order to prevent the introduction of erratic or inconsistent forces associated with the release action to the bowstring at the moment of release, the implementation of trigger devices with very sensitive release forces have occurred.

Also, it has been very desirable to allow the body of the bowstring release device to rotate relative to the hand and wrist of the archer for alignment with the bowstring so that only very minimal disruptive forces are transmitted to the bowstring from any position of the hand or wrist.

Due to the difference in physical stature between individuals, it has also been found to be advantageous to be able to adjust the distance between the bowstring engaging surfaces on the jaws of the bowstring release device and the hand or wrist of the archer. Adjustability in this dimension allows the individual archer to change the dimensional relationship to accommodate personal ergometric variations, such as length of the fingers and the position of the hand and wrist at the point of full draw of the bowstring prior to the moment of release.

SUMMARY OF THE INVENTION

It is an object of the invention to improve the release of the bowstring for greater accuracy of the arrow.

It is another object of the invention to minimize undesirable and inconsistent forces exerted onto the bowstring by such a release device by aligning the bowstring draw forces with the wrist of the archer.

It is an additional object of the invention to provide stabilization of the bowstring against undesired lateral movement of the bowstring at the moment of release and to guide the bowstring during its initial movement following release.

These and other objects of the invention are accomplished by entrapment of the bowstring between a pivotable jaw and a fixed jaw, such that the bowstring will be urged toward the fixed jaw and slide along the fixed jaw during its initial movement after bowstring release. The release is accomplished by permitting the pivotable jaw to pivot away from the fixed jaw, thereby opening a gap therebetween, permitting the bowstring to move away from the release mechanism under the influence of the limbs of the bow. A consistent release is obtained by use of a trigger mechanism contained within the bowstring release mechanism. The bowstring release mechanism is engaged with a wrist strap by a plate or ring, having two flat or straight sides. The wrist strap engages these two sides of the attachment ring and thereby delivers forces to the bowstring release mechanism in a consistent and predictable manner.

The force of the bowstring 20 exerted against jaw 14 will insure that the bowstring 20 will remain in engagement with jaw 14 after the complete release of the bowstring 20 and as the bowstring begins it forward movement to launch the arrow from the bow. The bowstring 20 remains in contact with jaw 14 for its entire movement along jaw 14. The engagement of the bow string 20 and jaw 14 will act to stabilize the lateral position of bowstring 20 during its initial flight and thus will eliminate some of the lateral movement which may be inherent in either a dual pivotable jaw release or a cord release.

The invention provides a pivotable connection between the body of the bowstring release and the attachment shaft so that the bowstring release body may pivot about its longitudinal axis for alignment with the bowstring. The pivotability of the body of the bowstring release relative to the attachment shaft and wrist strap eliminates the introduction of undesired and inconsistent forces which may adversely affect a clean smooth release of the bowstring and the bowstring movement that may affect the trajectory of the arrow.

BRIEF DESCRIPTION OF THE DRAWINGS

For a better understanding of the present invention, reference is made to the following detailed description of the invention which is to be read and understood in conjunction with the accompanying drawings wherein:

FIG. 4 illustrates the adjustability feature of the invention for accommodating varying ergometric characteristics of individuals and attachment to a wrist strap.

FIG. 5 illustrates an interconnection link or plate between the bowstring release subassembly and the wrist strap.

FIG. 6 illustrates an additional interconnection line or plate between the bowstring release subassembly and the wrist strap.

DETAILED DESCRIPTION OF THE BEST MODE

OF THE PREFERRED EMBODIMENT OF THE

INVENTION AS CONTEMPLATED BY THE INVENTOR

Figure 1:
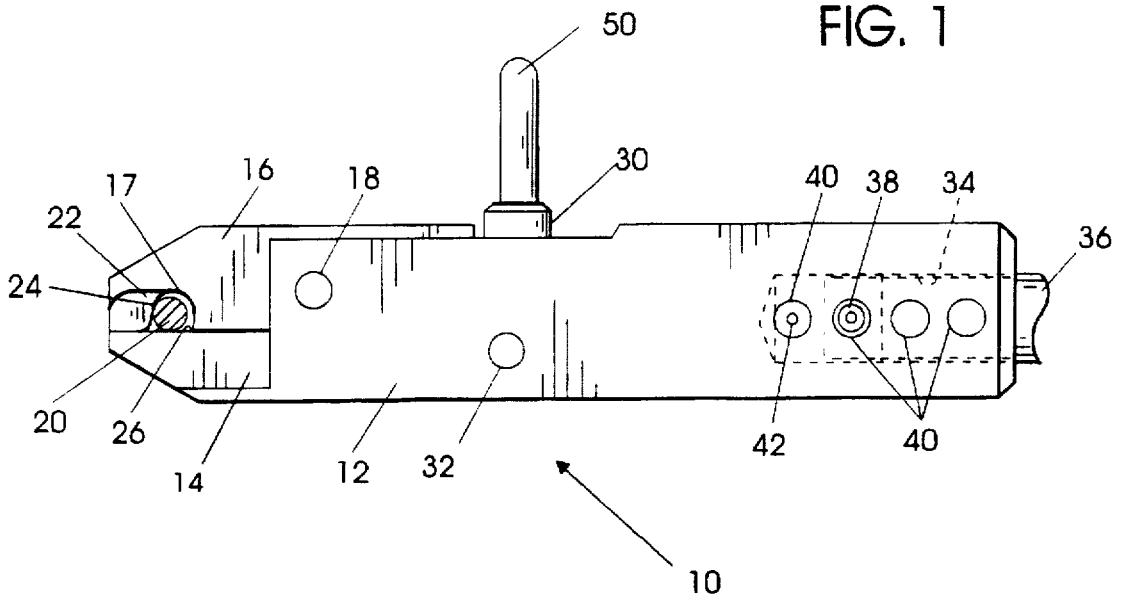
FIG. 1 illustrates the bowstring release of the present invention.

Referring initially to FIG. 1, the bowstring release subassembly 10 is shown and preferably has a cylindrical cross-section. The bowstring release subassembly 10 may be other than cylindrical if desired. The bowstring release subassembly 10 is comprised of a body 12 and a lower fixed jaw 14 extending from one end of body 12. A pivotable jaw 16 is disposed in a juxtaposed position with fixed jaw 14. Pivoted jaw 16 is supported for its pivot action around and by pivot pin 18 extending transversely through the body 12. Pivotable jaw 16 is provided with a notch 17 to accommodate a bowstring 20. The jaw 16 is further relieved in regions 22 so that the bowstring 20, whenever withdrawn, is engaged in essentially a point contact at point 24 between the relieved region 22 of pivotable jaw 16 and bowstring 20. Lateral motion of the bowstring 20 is restricted by engagement between bowstring 20 and the planar surface 26 of fixed jaw 14 by forces exerted on bowstring 20 by jaws 16, 14.

The bowstring release subassembly 10 is further provided with a trigger release mechanism 30 which is pivotally mounted on pivot pin 32.

The body 12 of the bowstring release 10 is further provided with a coaxially bored hole 34 extending from the right end of the body 12 as viewed in FIG. 1. The bored hole 34 permits the insertion of attachment shaft 36 therein. Attachment shaft 36, to be described in more detail later, may be retained in the bored hole 34 by a retaining bolt 38 inserted into one of a plurality of transverse holes 40. On the opposite side of body 12 from hole 40, a similar hole 42 may be provided for each of the holes 40 and be internally tapped for threaded engagement with the retaining bolt 38. Holes 40 may be fabricated of such a size as to accept the head 37 of bolt 38 which may be in the form of a cap screw. By removing the cap screw or bolt 38 and repositioning shaft 36 relative to body 12 and reinserting the bolt 38 into one of the holes 40 and threadedly engaging the threads of the bolt 38 with the threads of hole 42, the position of shaft 36 may be adjusted relative to body 12 to change the overall length.

Figure 2:
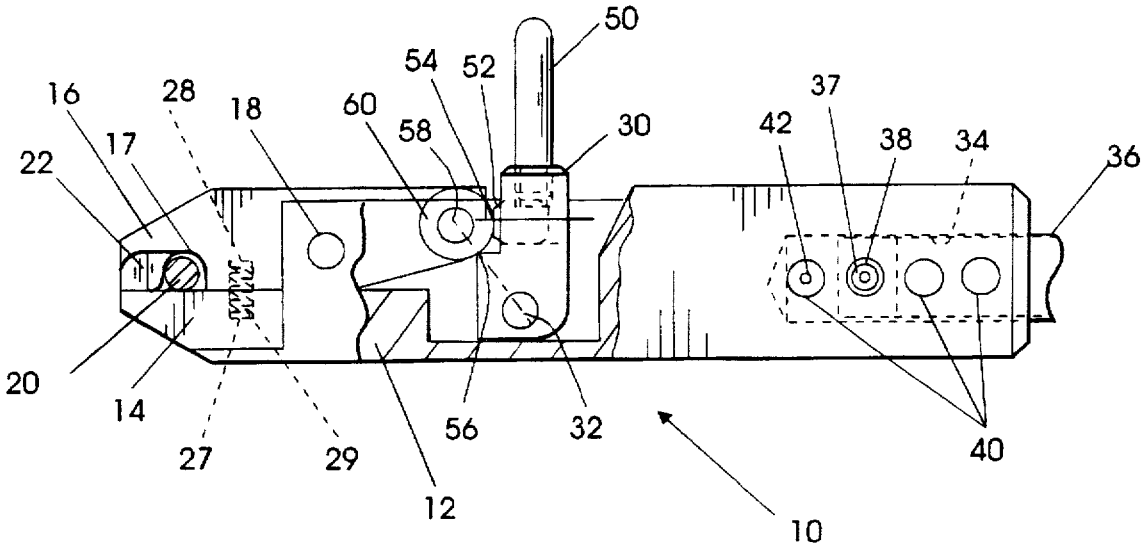
FIG. 2 illustrates the bowstring release with the pivot jaw closed and the trigger mechanism exposed.

Referring now to FIG. 2, like elements of the device carry the same reference numeral as the same element in FIG. 1 and will not be redescribed in any substantial detail. FIG. 2 illustrates cavity 27 formed into the fixed jaw 14 and cavity 28 formed into movable or pivotable jaw 16. Cavities 27 and 28 function to contain coil spring 29 which is held in compression and tends to urge jaw 16 to pivot in a clockwise direction about pivot pin 18.

A portion of body 12 has been removed to expose the structure and operation of the trigger mechanism 30. Trigger mechanism 30 is pivoted about pivot pin 32 and has extending therefrom a finger engageable trigger 50. An adjustable member 52, by way of example, such as a hex head set screw is threadedly engaged with trigger mechanism 30. Set screw 52 may be turned out or in with respect to trigger mechanism 30 to control the distance between the end face 54 of set screw 52 and trigger mechanism 30. Trigger mechanism 30 further possesses a sharp shoulder or sear 56 which extends toward the jaws 14, 16 from the mechanism 30. Journaled on pin 58 on the proximal end of jaw 16 is a roller 60. Roller 60 is free to turn on pin 58 with respect to jaw 16. Sear 56 is locatable against and engages roller 60 by pivoting the trigger 50 and trigger mechanism 30 counterclockwise about pivot pin 32. Sear 56, roller engagement will be unstable until its counterclockwise movement about pivot pin 32 moves sear 56 past the center line between the centers of pivot pin 58 and pivot pin 32. Once sear 56 has passed the center line between the centers of these two pins 58, 32, the forces exerted on the sear 56 by roller 60 in response to the expansion of spring 29 will cause the trigger mechanism 30 to be maintained in its cocked position and maintained in a stable condition. During the cocked and stable condition of trigger mechanism 30, the end face 54 of set screw 52 will engage the periphery of roller 60. Trigger pull, the amount of force necessary to be exerted on trigger 50 in order to cause the sear 56 to be moved clockwise past the center line between the centers of pins 58 and 32, is controllable by the position of trigger mechanism 30 as positioned by set screw 52. For a trigger pull to have substantial magnitude, the sear 56 should be permitted to pass the center line extending between pins 58 and 32 by a substantial distance so that the roller 60 resists movement of trigger mechanism 30. This requires the set screw 52 to be threaded into trigger mechanism 30 a substantial distance. Similarly, if the trigger pull desired on trigger mechanism 30 and trigger 50 is to be small, then the sear 56 should be maintained as close to the center line extending between the centers of pins 32 and 58 as can be reasonably maintained. Threading set screw 58 partially out of trigger mechanism 30 will extend the position of set screw 52 and prevent trigger mechanism 30 from rotating as far counterclockwise as occurs whenever the set screw 52 is threaded well into the trigger mechanism 30. With bowstring 20 trapped between jaws 14 and 16 and the trigger mechanism 30 engaging through sear 56, and the roller 60, the bowstring release 10 is cocked and ready for manual release by finger engagement with trigger 50. As trigger 50 is pulled or touched by the archer's finger, sear 56 will force roller 60 away from pin 32 by a minute amount; will pass over center, past the center line which extends between pivot pins 32 and 58. Upon passage of sear 56 over center, the configuration of the roller 60 and the sear 56 engagement will act to push sear 56 and also trigger mechanism 30 in a clockwise direction, permitting roller 60 to move generally downward as illustrated in FIG. 2.

Figure 3:
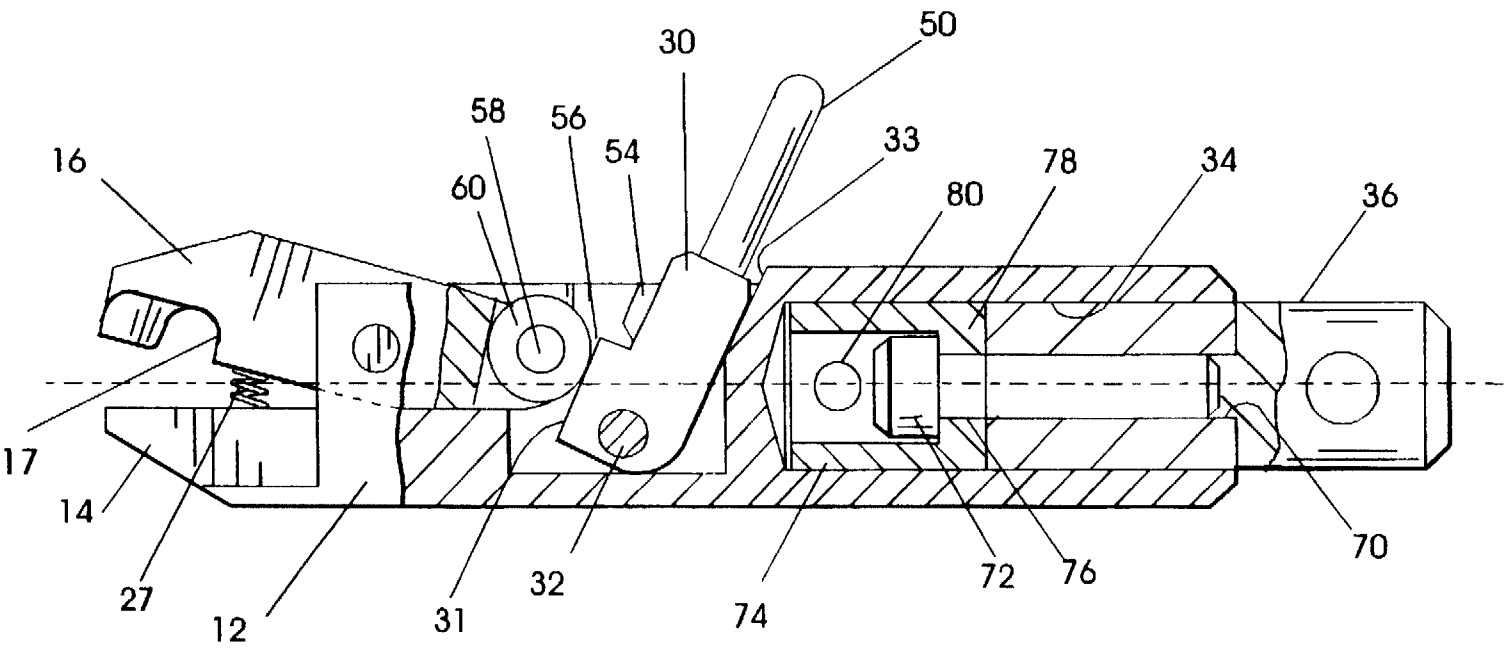
FIG. 3 illustrates the bowstring release with the pivot jaw open and the trigger mechanism exposed.

The condition of the bowstring release 10 after the trigger 50 has been pulled and release of the bowstring 20 or prior to engagement with a bowstring and cocking is more clearly illustrated in FIG. 3. As can be best observed in FIG. 3, jaw 16 has been pivoted about pivot pin 18 in a clockwise direction moving pivot pin 58 and roller 60 down the front face 31 of trigger mechanism 30 causing trigger mechanism 30 to pivot clockwise about pivot pin 32 until stopped by the stop surface 33 of body 12.

Body 12 is bored to provide a bore 34 to permit the body 12 and accordingly the bowstring release mechanism 10 to rotate about its longitudinal axis in order to permit the ready alignment of jaws 14 and 16 with the bowstring; such rotation is a most desirable feature of the invention. As shaft 36 is likewise bored or drilled to provide a bore 70. The inner surface of bore 70 is then threaded to accept a cap screw 72. A cup-shaped member 74 is provided with a hole 76 through the base 78 to permit the insertion of cap screw 72 therethrough. The cup 74 is further drilled transverse to the longitudinal axis of cup 74 to form a hole 80 through opposite sides of cup 74 to permit the insertion of a pin or screw 38, as shown in FIG. 1.

Cup 74 and attached shaft 36 are inserted into bore 34 and cap screw 38 of FIG. 1 inserted through any of the holes 40 as illustrated in FIG. 1 and hole 80 to provide the adjustment capability to lengthen or to shorten the overall distance between notch 17 and the wrist strap 81 as illustrated in FIG. 4.

Referring now to FIG. 4, the bowstring release subassembly 10 is illustrated attached to a wrist strap 81. Wrist strap 81 is provided with a means for attachment such as a buckle 82 but it should be understood and recognized that other attachment techniques, such as a piece of webbing threaded through double D rings or the use of hook and loop attachments, such as Velcro brand attachment, could be also used. Wrist strap 81 is fabricated to be in the form of a generally L-shaped strap 81 in order to concentrate the forces exerted from the strap 81 onto the bowstring release 10 at a relatively fixed and defined point which may be then positioned relative to the archer's wrist. The vertex of strap 81 typically will be positioned on the inside of the wrist and overlying the heel of the hand. In order to control the direction and location of the force transmitted from wrist strap 81 to shaft 36, a ring 84 is provided. The ring 84 is attached to the wrist strap 81 by tabs 86 threaded through the opening 87 of ring 84 and then sewed or otherwise fixedly attached to strap 81. Ring 84 is relatively fixed with respect to strap 81 by virtue of the fact that the ring 84 is formed having two legs or branches 90 which form an intersection having an angle substantially equal to the angle between the branches 92 of wrist strap 81. By having the same vertex angles, tabs 86 will confine the ring 84 to the desired location and will not permit rotational movement relative to strap 81. Further, since tabs 86 engaging branches 90 of ring 84 will be acting onto relatively straight branches 90, the forces exerted by strap 81 and tabs 86 onto ring 84 will be defined with respect to direction. Ring 84 further is provided with a hole, not shown, through which a pin 94 may be inserted to attach shaft 36 to ring 84 thereby providing a pivotable connection about the axis of pin 94.

The ring 84 may take other forms such as plates 94 shown in FIGS. 5 and 6, with slots 88 disposed generally parallel to two straight sides 89, permitting tabs 90 to be threaded through slots 88.

To operate the bowstring release, strap 81 is positioned around the wrist of the archer and fastened to snugly position the strap 81 around the wrist. The arm and hand of the archer then is extended to close proximity to the bowstring 20 and body 12 of bowstring release 10 rotated about its longitudinal axis to permit the bowstring 20 to be inserted into notch 17 as illustrated in FIGS. 1 or 2, and trigger 50 disposed for engagement by the archer's finger. Thereafter, pivotable jaw 16 then is closed surrounding bowstring 20 and then is held in its closed or cocked position by the trigger mechanism 30 being pushed in a counterclockwise direction around pivot pin 32. As trigger mechanism 30 is pushed counterclockwise around pivot pin 32, sear 56 will engage roller 60 and will latch roller 60 and jaw 16 in the closed position. The archer then may draw the 30 bowstring 20 by pulling his arm away from the bow. After the bowstring 20 is fully drawn and aim properly taken, then the bowstring release 10 may be released or fired by the archer engaging trigger 50 with a finger and moving trigger 50 slightly to the rear away from bowstring 20 and clockwise around pin 32. As trigger mechanism 30 is moved clockwise about pivot pin 32 by trigger 50, the sear 56 will pass the center line between pivot pin 58 and pivot pin 32 causing the release of roller 60 thereby permitting jaw 16 to pivot about pivot pin 18. As the jaw 16 begins to open, the force exerted by jaw 16 onto bowstring 20 will tend to cause the bowstring 20 to forcibly engage jaw 14. The bowstring 20 will be retained in its drawn condition and forced against jaw 14 until such time as jaw 16 has pivoted about pivot pin 18 to create a sufficiently large gap between jaw 16 and jaw 14 for the bowstring 20 to pass therethrough.

The force of the bowstring 20 exerted against jaw 14 will insure that the bowstring 20 will remain in engagement with jaw 14 after the complete release of the bowstring 20 and as the bowstring begins its forward movement to launch the arrow from the bow. The bowstring 20 remains in contact with jaw 14 for its entire movement along jaw 14. The engagement of the bowstring 20 and jaw 14 will act to stabilize the lateral position of bowstring 20 during its initial flight and thus will eliminate some of the lateral movement which may be inherent in either a dual pivotable jaw release or a cord release. Needless to say, an unaided finger release will clearly introduce some lateral movement to the bowstring 20 at the time of release. Inasmuch as the bowstring 20 is pulled taut, the bowstring 20 will have a tendency to vibrate in response to any lateral forces on it. The introduced vibrations become an undesirable factor in the control of the true and accurate flight of an arrow.

Once the archer has become familiar with the operation of this device, trigger pull may be adjusted by threading the set screw 52 into or out of the trigger mechanism 30 to control the position of trigger mechanism 30 relative to roller 60. For a very light trigger pull, the sear 56 should be positioned very close to the center line extending between the centers of pivot pin 58 and pivot pin 32. For a more substantial trigger pull, the sear 56 should be displaced in a counterclockwise direction about pivot pin 32 and farther from the center line between pivot pins 58 and 32 than the position occupied for a light or small trigger pull.

It should be understood that minor changes and variations in the implementation of specific aspects of the invention may occur to one of skill in the art and may be implemented without departing from the scope of the appended claims.

I claim:

1. A bowstring release for engaging, drawing and releasing an archery bowstring, comprising:

a wrist strap;

a body attached to said wrist strap;

a pair of jaws, one of said jaws fixed with respect to said body, said fixed jaw having a face thereof in the form of a plane, said plane disposable against a bowstring;

a second one of said pair of jaws pivoted with respect to said fixed jaw and said body, said pivoted jaw pivoted about a pivot axis disposed between a jaw releasing end and a bowstring engaging end, said pivoted jaw having a face proximate said bowstring engaging end disposed in juxtaposition with said face of said fixed jaw and said face interrupted by a bowstring notch, said bowstring notch having a surface closest to said bowstring engaging end, said bowstring notch surface being curved to smoothly engage said bowstring;

said bowstring notch surface inclined to form an acute angle with said fixed jaw face;

a trigger pivotally disposed within and extending from said body, said trigger cooperatively associated with said jaw releasing end of said pivotable jaw in a holding position blocking said jaw from moving to a bowstring release position, whereby said bowstring is retained in said release by said bowstring notch and is urged against said fixed jaw face by said bowstring notch surface forming said acute angle and said fixed jaw face engages said bowstring during the initial phase of flight of said bowstring upon release, thereby stabilizing said bowstring against undesirable lateral movement immediately following release.

2. The bowstring release of claim 1 further comprising a spring biasing said pivoted jaw to an open position.

3. A bowstring release for engaging, drawing and releasing an archery bowstring, comprising:

a body;

a pair of jaws, one of said jaws fixed with respect to said body, said fixed jaw having a face thereof in the form of a plane, said plane disposable against a bowstring;

a second one of said pair of jaws pivoted with respect to said fixed jaw and said body, said pivoted jaw pivoted about a pivot axis disposed between a jaw release end and a bowstring engaging end of said pivoted jaw, said pivoted jaw having a face proximate said bowstring engaging end disposable in juxtaposition with said face of said fixed jaw, said pivoted jaw face interrupted by a bowstring notch, said bowstring notch opening toward said fixed jaw and having a surface closest to said bowstring engaging end curved to smoothly engage said bowstring when said bowstring is drawn;

said bowstring notch surface inclined, forming an acute angle with said fixed jaw face;

a jaw release disposed within, pivoted on and extending from said body, said jaw release cooperably associated with said jaw release end of said pivoted jaw in a holding position blocking said pivoted jaw from moving to a bowstring release position, whereby said bowstring is retained by said pair of jaws, when in closed relation, in said bowstring notch and is urged against said fixed jaw face by said bowstring notch surface and bowstring tension when said bowstring is drawn and said fixed jaw face engages and guides said bowstring upon release, thereby stabilizing said bowstring against undesirable lateral movement immediately following release.

4. The bowstring release of claim 3 further comprising a spring biasing said pivoted jaw to an open position.

5. The bowstring release of claim 3 wherein said fixed jaw is formed integrally with said body.

6. The bowstring release of claim 3 further comprising a wrist strap and said body rotatably connected to said wrist strap.

* * * * *